US012150527B2

(12) United States Patent
Beall et al.

(10) Patent No.: US 12,150,527 B2
(45) Date of Patent: Nov. 26, 2024

(54) INTERCHANGEABLE JEWELRY APPARATUS

(71) Applicants: David Beall, Clarksville, TN (US); Barbara Beall, Clarksville, TN (US)

(72) Inventors: David Beall, Clarksville, TN (US); Barbara Beall, Clarksville, TN (US)

( * ) Notice: Subject to any disclaimer, the term of this patent is extended or adjusted under 35 U.S.C. 154(b) by 0 days.

(21) Appl. No.: 18/124,662

(22) Filed: Mar. 22, 2023

(65) Prior Publication Data

US 2024/0315409 A1 Sep. 26, 2024

(51) Int. Cl.
*A44C 25/00* (2006.01)
*A44C 15/00* (2006.01)

(52) U.S. Cl.
CPC ..... *A44C 25/001* (2013.01); *A44C 15/004* (2013.01)

(58) Field of Classification Search
CPC . A44C 25/001; A44C 15/004; A44C 15/0025; A44C 17/02; A44C 17/0216; A44C 17/0225; A44C 7/002; A44C 9/0061; A44C 25/007; A44C 17/0208; G09F 1/12; G09F 3/207; G09F 2007/1843
USPC ..... 63/29, 29.1; 40/542.02, 648, 653, 654, 40/658, 661.05
See application file for complete search history.

(56) References Cited

U.S. PATENT DOCUMENTS 897,274 A * 9/1908 Denton ..... A44C 17/02 63/26
3,509,734 A 6/1967 Lederer
4,970,878 A * 11/1990 Lee ..... A44C 25/001 63/23
4,982,581 A 1/1991 Furuyama
5,414,948 A * 5/1995 Kudo ..... G09F 3/20 63/23
5,617,751 A * 4/1997 Song ..... A44B 15/005 206/38.1
7,257,967 B2 8/2007 Rheinstein
7,409,837 B2 8/2008 Smith
7,640,636 B2 1/2010 Clark
7,877,909 B1 * 2/2011 Hagen ..... G09F 3/14 63/23
10,264,897 B1 * 4/2019 Chen ..... A47G 1/0616
10,588,385 B1 * 3/2020 Borgese ..... A01K 27/006
2011/0083348 A1 * 4/2011 Brouwer ..... A44C 3/001 224/257
2014/0352857 A1 * 12/2014 Warren ..... A45C 3/06 63/29.1

FOREIGN PATENT DOCUMENTS

WO WO9844821 10/1998

* cited by examiner

*Primary Examiner* — Jack W Lavinder

(57) ABSTRACT

An interchangeable jewelry apparatus for displaying interchangeable indicia includes a base with an aperture extending through a front side and a rear side of the base. The base has a first notch extending into the rear side adjacent to the aperture. An insert panel is removably couplable to the base such that the insert panel is positioned in the aperture of the base. The insert panel comprises a body and a first tab which are coupled to each other. The first tab is received into the first notch when the insert panel is 10 coupled to the base, and the first notch is shaped such that the first tab snap fits to the base when the first tab is received into the first notch. An indicia is coupled to the front face of the insert panel.

19 Claims, 8 Drawing Sheets

INTERCHANGEABLE JEWELRY APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to jewelry and more particularly pertains to a new jewelry apparatus for displaying interchangeable indicia.

(2) Description of Related Art Including Information Disclosed Under 37 CFR 1.97 and 1.98

The prior art includes several jewelry apparatuses which include an interchangeable ornamental component. However, the prior art does not disclose an apparatus in which a panel with tabs is positionable in an aperture of a base member such that the tabs snap fit into the base member and indicia on the panel is displayed through the aperture.

BRIEF SUMMARY OF THE INVENTION

An embodiment of the disclosure meets the needs presented above by generally comprising a base with an aperture extending through a front side and a rear side of the base. The base has a first notch extending into the rear side adjacent to the aperture. An insert panel is removably couplable to the base such that the insert panel is positioned in the aperture of the base. The insert panel comprises a body and a first tab which are coupled to each other. The first tab is received into the first notch when the insert panel is coupled to the base, and the first notch is shaped such that the first tab snap fits to the base when the first tab is received into the first notch. An indicia is coupled to the front face of the insert panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
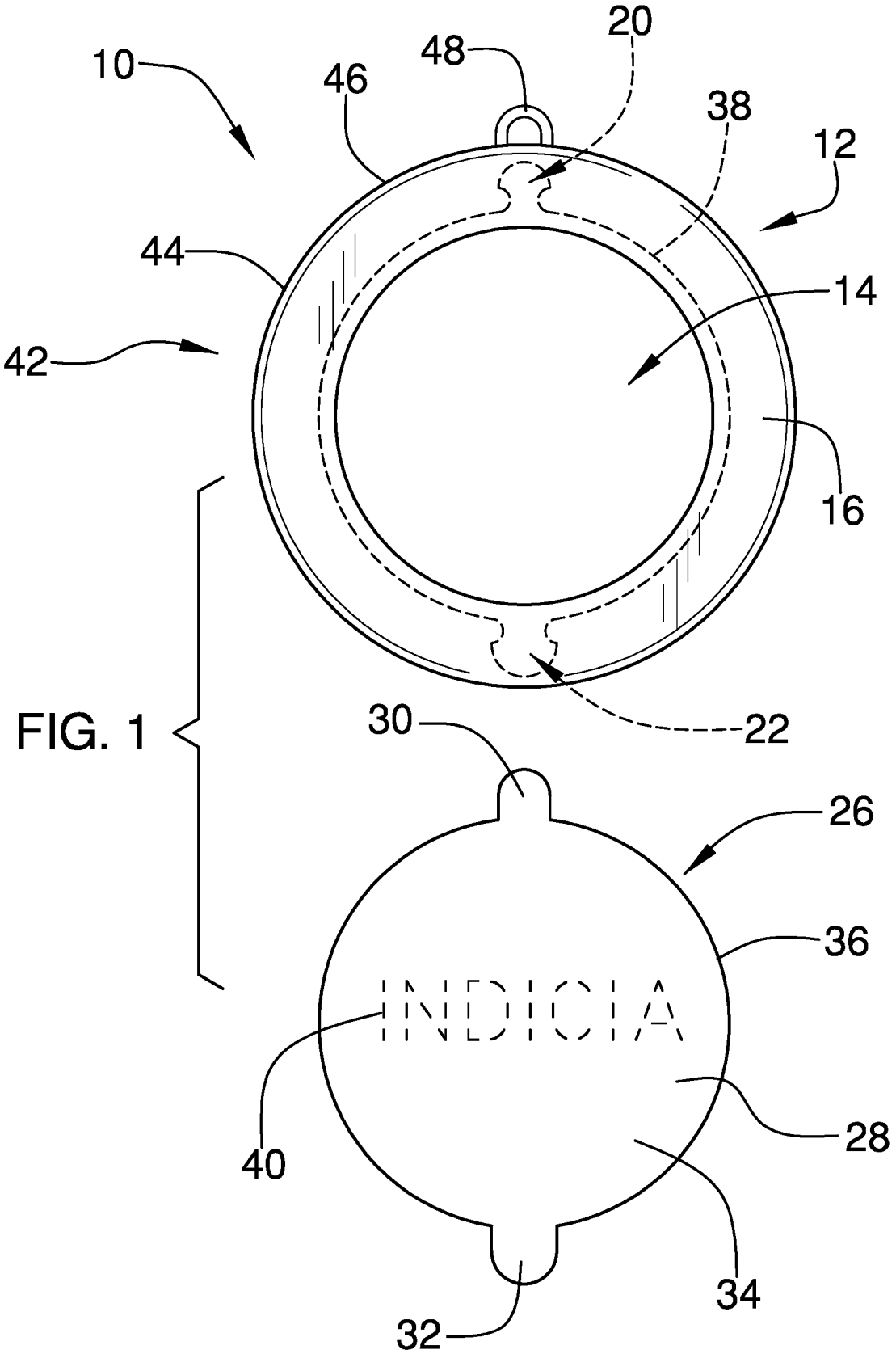
FIG. 1 is a front view of an interchangeable jewelry apparatus according to a first embodiment of the disclosure.
Figure 2:
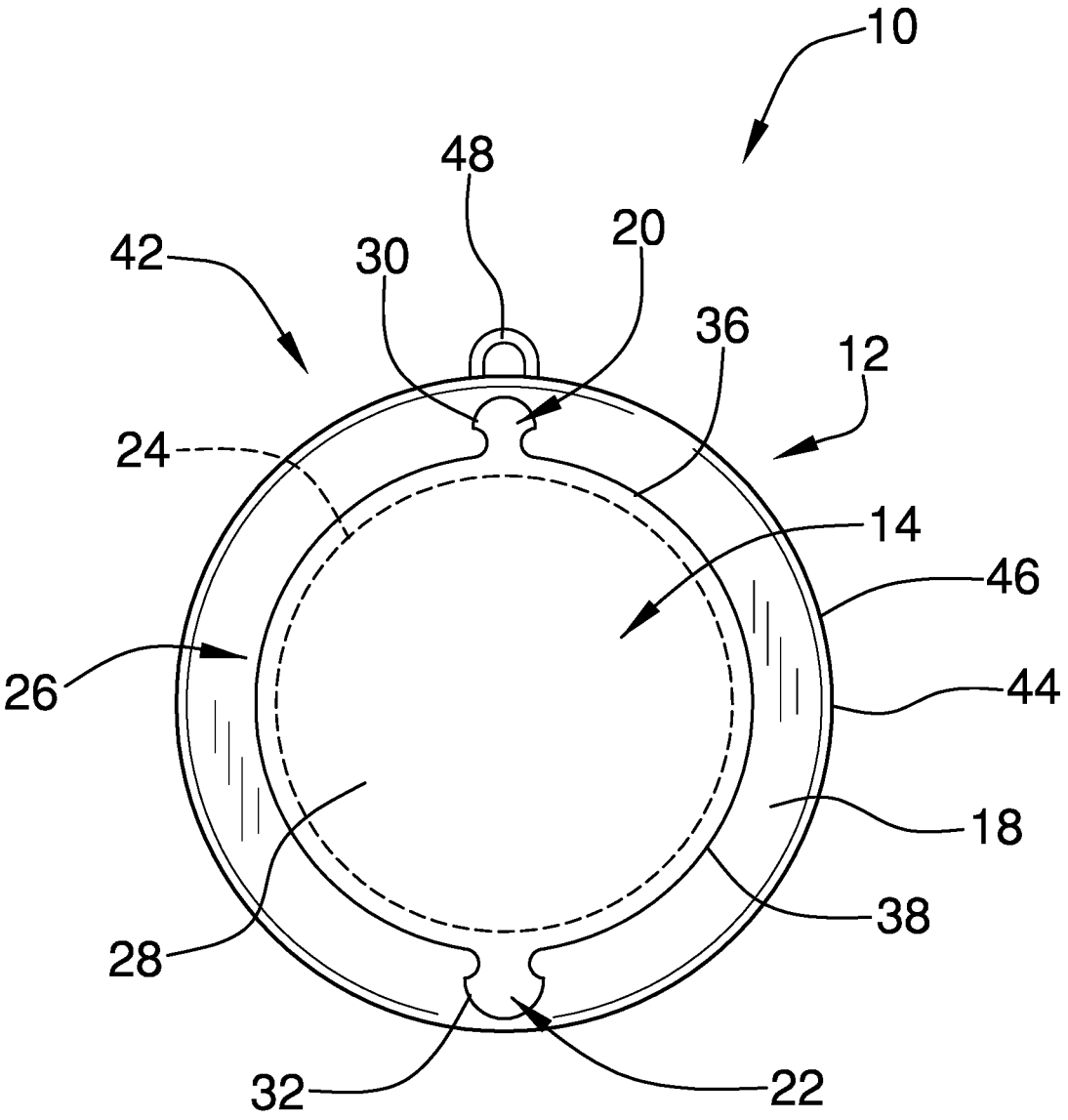
FIG. 2 is a rear view of a first embodiment of the disclosure.
Figure 3:
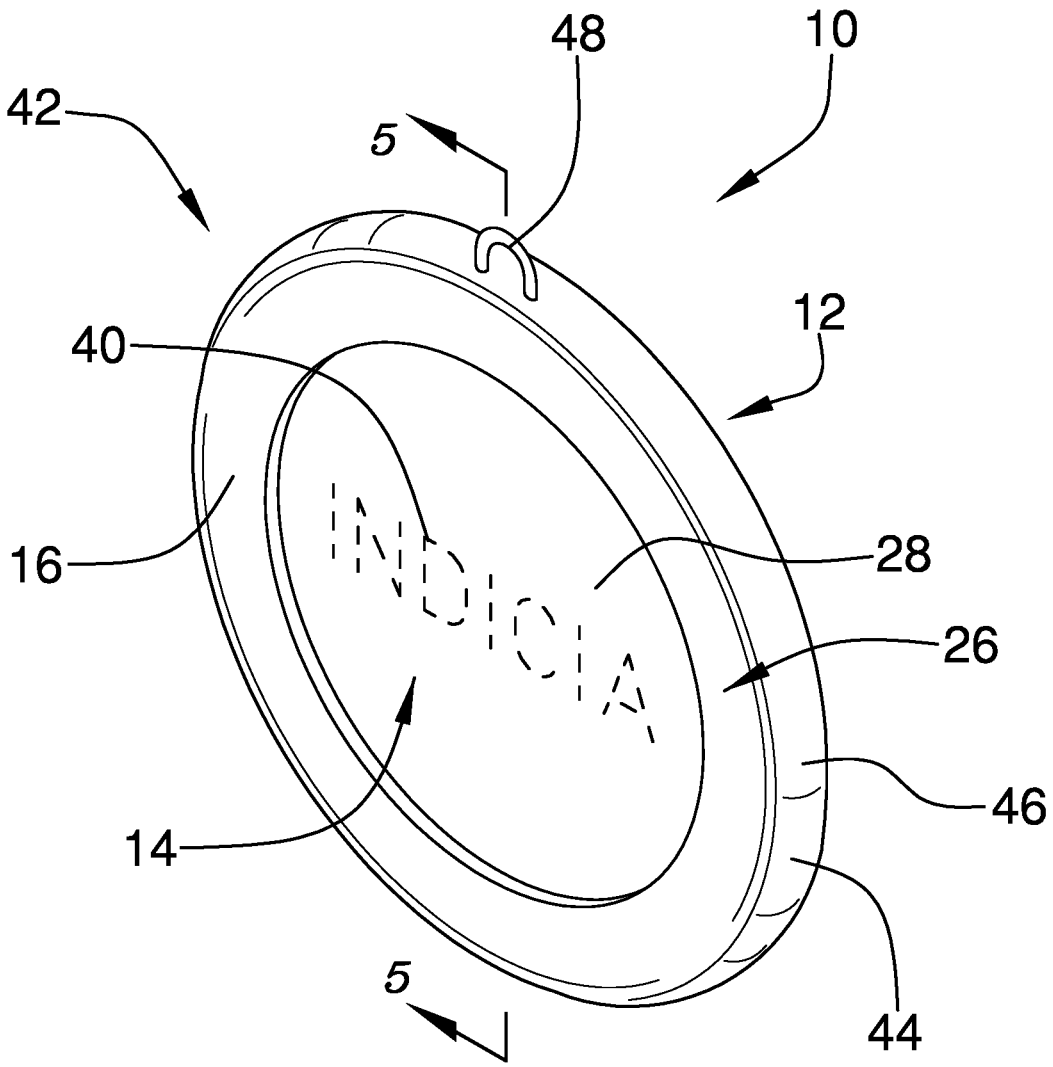
FIG. 3 is a top front side perspective view of a first embodiment of the disclosure.
Figure 4:
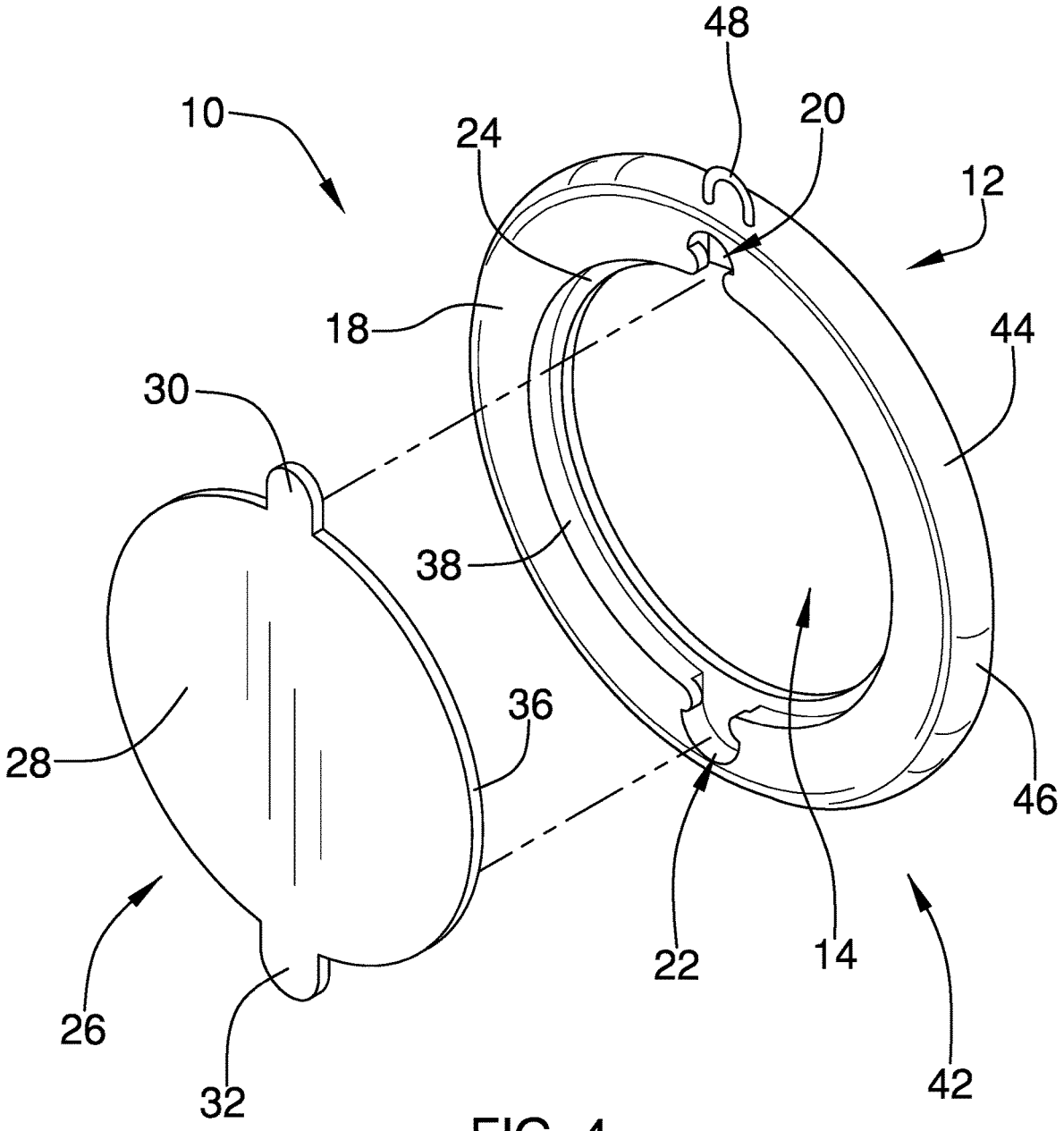
FIG. 4 is a top rear side perspective view of a first embodiment of the disclosure.
Figure 5:
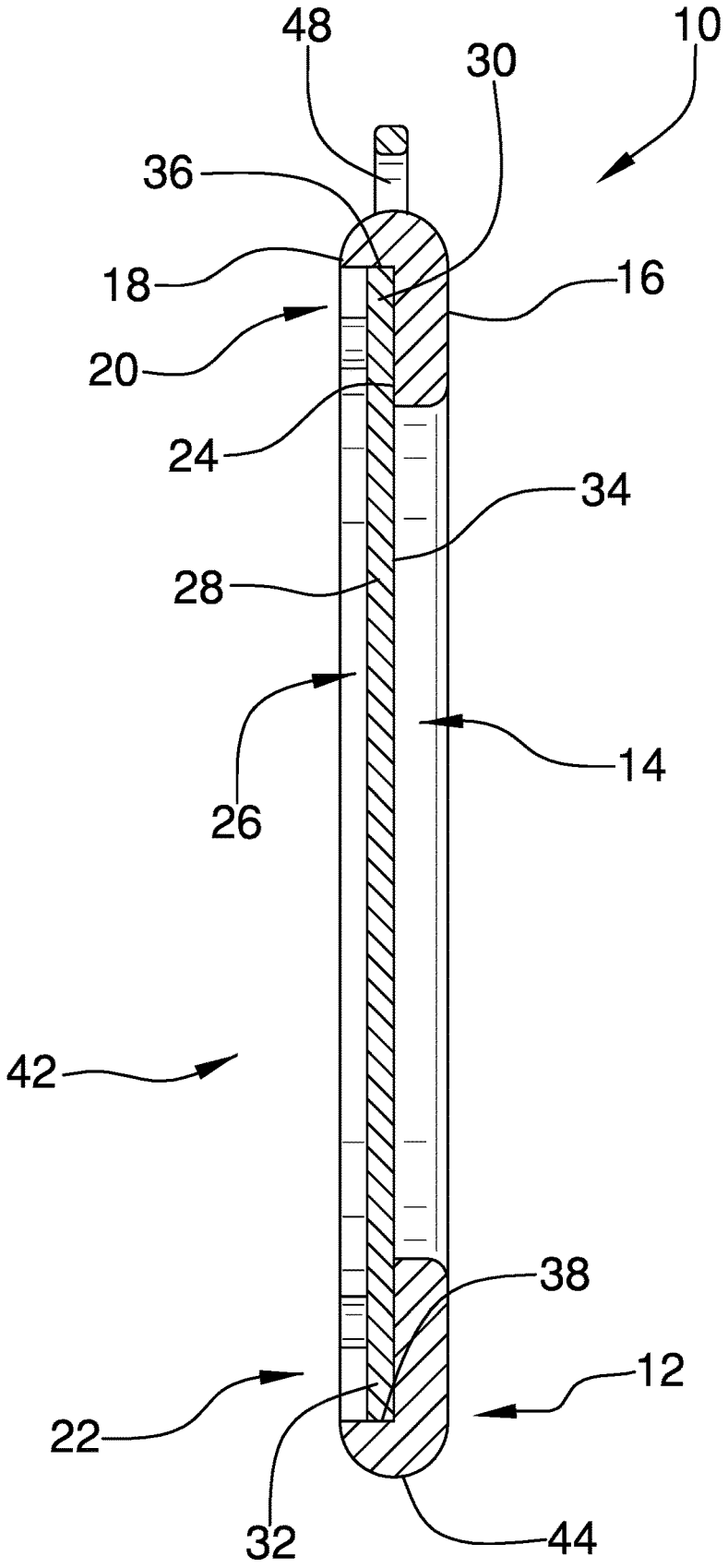
FIG. 5 is a cross-sectional view of a first embodiment of the disclosure taken from Arrows 5-5 in FIG. 3.
Figure 6:
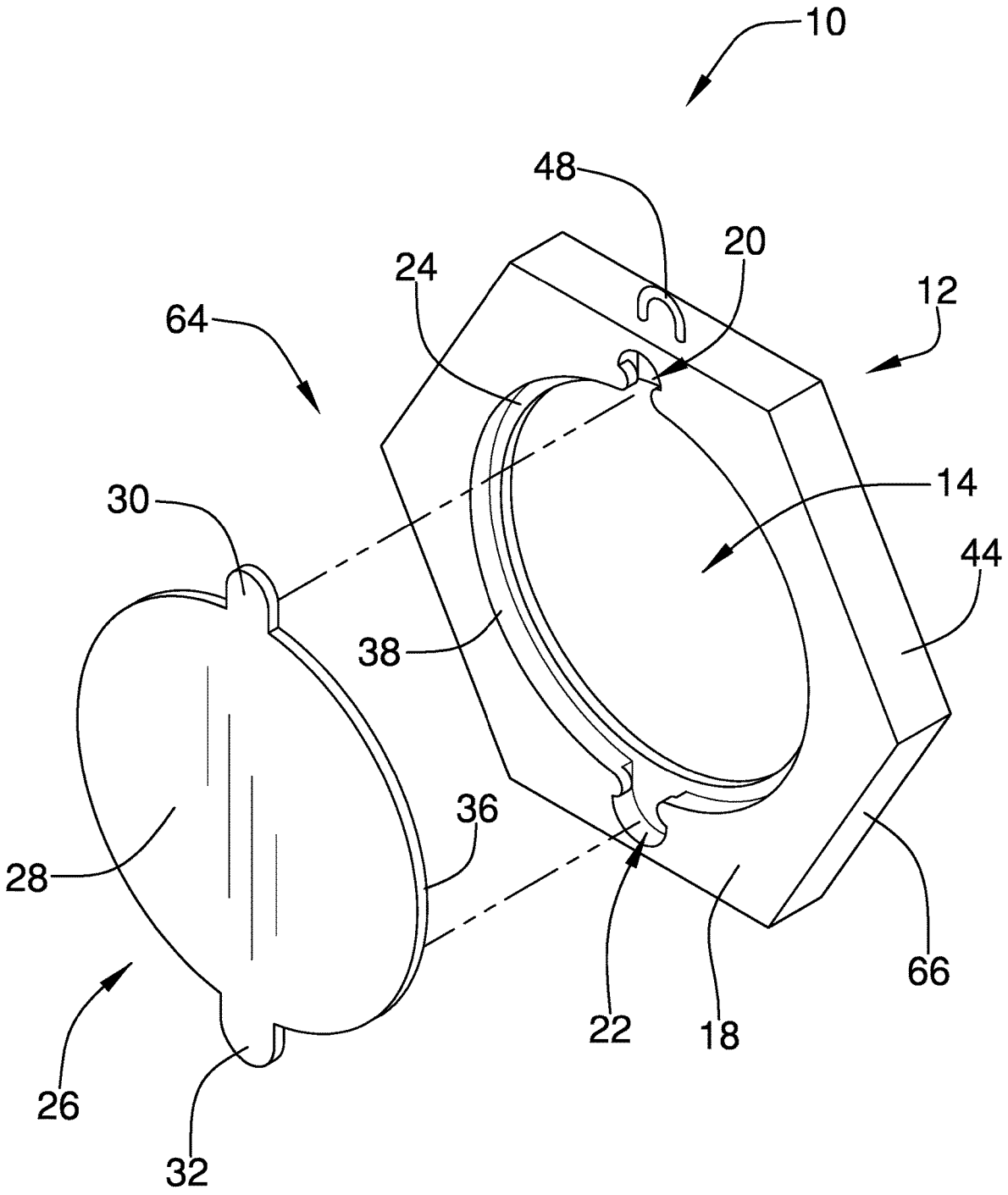
FIG. 6 is a perspective view of a second embodiment of the disclosure.
Figure 7:
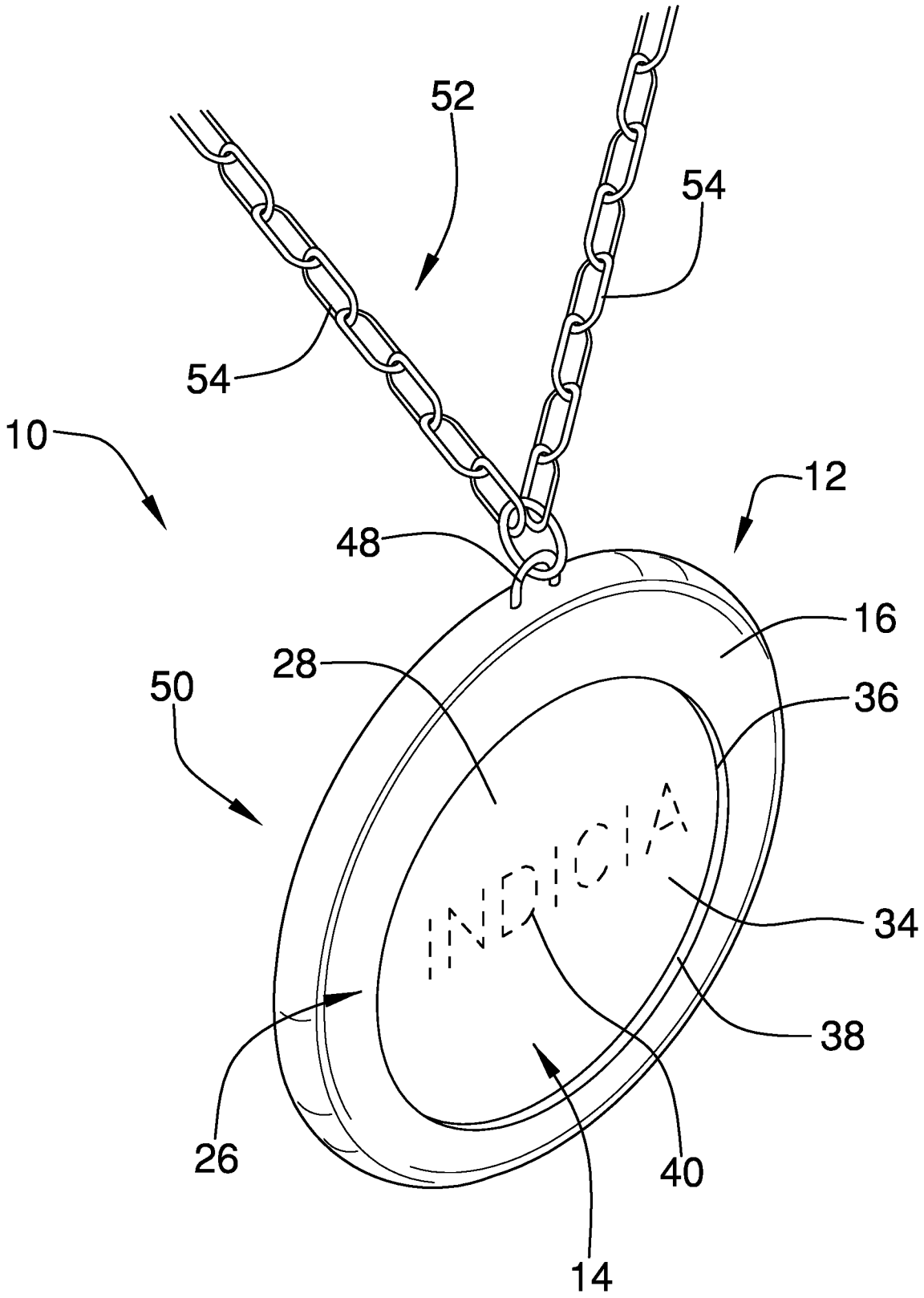
FIG. 7 is a perspective view of a third embodiment of the disclosure.
Figure 8:
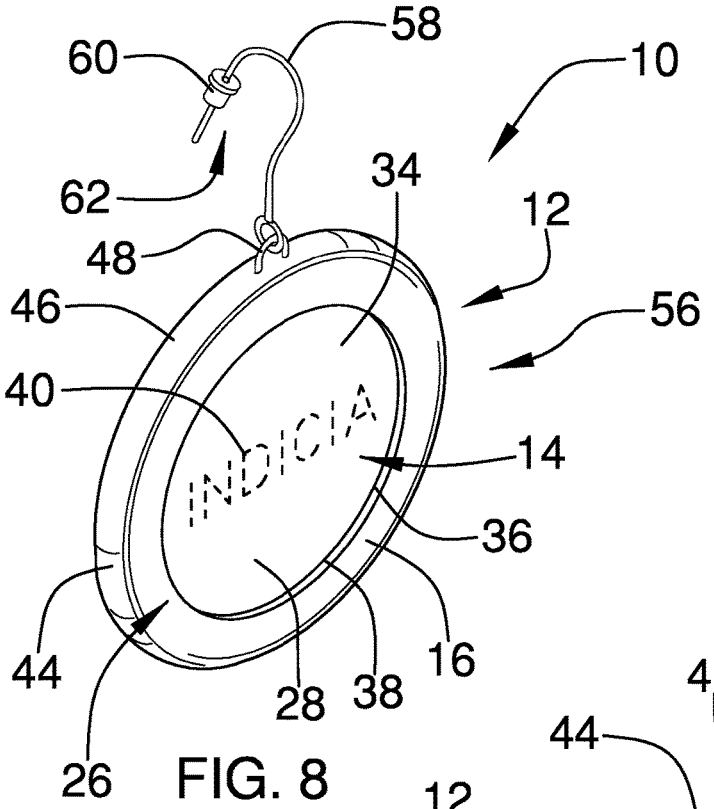
FIG. 8 is a perspective view of a fourth embodiment of the disclosure.
Figure 9:
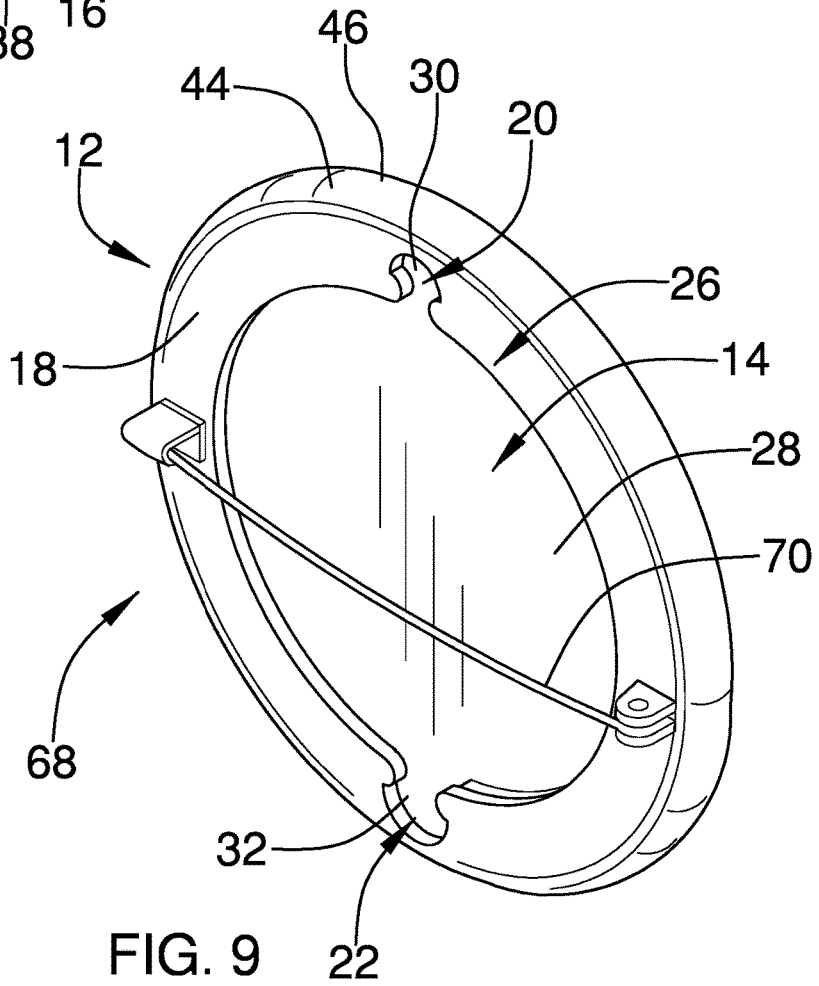
FIG. 9 is a perspective view of a fifth embodiment of the disclosure.

With reference now to the drawings, and in particular to FIGS. 1 through 9 thereof, a new jewelry apparatus embodying the principles and concepts of an embodiment of the disclosure and generally designated by the reference numeral 10 will be described.

As best illustrated in FIGS. 1 through 9, the interchangeable jewelry apparatus 10 generally comprises a base 12 with an aperture 14 extending through a front side 16 and a rear side 18 of the base 12. The base 12 has a first notch 20 extending into the rear side 18 which is positioned adjacent to the aperture 14. The base 12 has a second notch 22 extending into the rear side 18 which is positioned adjacent to the aperture 14 across the aperture 14 from the first notch 20. The base 12 has a seat surface 24 which extends around the aperture 14 and faces rearwardly with respect to the front side 16 of the base 12.

An insert panel 26 is removably couplable to the base 12 and is positioned in the aperture 14 of the base 12 when the insert panel 26 is coupled to the base 12. The insert panel 26 comprises a body 28, a first tab 30, and a second tab 32. The first tab 30 and the second tab 32 are each coupled to the body 28. The first tab 30 is received into the first notch 20 and the second tab 32 is received into the second notch 22 when the insert panel 26 is coupled to the base 12. A front face 34 of the insert panel 26 abuts the seat surface 24 of the base 12 when the insert panel 26 is coupled to the base 12. The first and second notches 20, 22 are shaped such that the first and second tabs 30, 32 snap fit to the base 12 when the first and second tabs 30, 32 are received into the first and second notches 20, 22 respectively. The second notch 22 has a different size to a size of the first notch 20 such that the insert panel 26 cannot be coupled to the base 12 with the first tab 30 is received into the second notch 22 and the second tab 32 is received into the first notch 20. The insert panel 26 has a peripheral edge 36 which is circular and coextensive with a perimeter 38 of the aperture 14 when the insert panel 26 is coupled to the base 12.

An indicia 40 is coupled to the front face 34 of the insert panel 26. The term "indicia" as used in the specification and the claims is used to refer to both a singular marking and a plurality of markings. The indicia 40 may include an ornamental design, an alphanumeric character, a graphical image, a symbol, or the like. The indicia 40 may also include a decorative material such as a gemstone, a bead, a precious metal, or the like. The indicia 40 may be integrally formed with the insert panel 26.

In a first embodiment 42 of the interchangeable jewelry apparatus 10, the base 12 has an exterior surface 44 which extends between the front side 16 and the rear side 18. The exterior surface 44 has a circular shape 46 and is rounded between the front side 16 and the rear side 18. The first embodiment 42 further comprises an attachment loop 48 which is coupled to the exterior surface 44 of the base 12 adjacent to the first notch 20 of the base 12.

A second embodiment 50 of the interchangeable jewelry apparatus 10 comprises the first embodiment 42 and further comprises a necklace 52 which is attached to the attachment loop 48. The necklace 52 has a pair of segments 54, each of which extends away from the attachment loop 48.

A third embodiment 56 of the interchangeable jewelry apparatus 10 comprises the first embodiment 42 and further comprises a hook 58 which is coupled to the attachment loop 48. The hook 58 has a size such that the hook 58 is configured for inserting through a piercing hole of an ear, and a catch 60 is removably coupled to the hook 58 The catch 60 is slidably positionable on the hook 58 into a selected position 62 such that the catch 60 is frictionally secured to the hook 58 such that the catch 60 secures through the piercing hole of the ear.

In a fourth embodiment 64 of the interchangeable jewelry apparatus 10, the base 12 has an exterior surface 44 that extends between the front side 16 and the rear side 18 and has a hexagonal shape 66. The fourth embodiment 64 further comprises an attachment loop 48 which is coupled to the exterior surface 44 of the base 12 adjacent to the first notch 20 of the base 12.

A fifth embodiment 68 of the interchangeable jewelry apparatus 10 comprises a safety pin 70 which is coupled to the rear side 18 of the base 12 and extends across the aperture 14.

In use, the insert panel 26 is coupled to the base 12 to display the indicia 40 through the aperture 14 of the base 12. Several insert panels 26 with unique indicia 40 may be interchangeably coupled to the base 12. Depending on the embodiment, the base 12 may be coupled to the necklace 52, the hook 58, the safety pin 70, or other like attachment means to display the indicia 40 on a body 28 or clothing of a user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An interchangeable jewelry apparatus comprising:

a base having an aperture extending through a front side and a rear side of the base, the base having a first notch extending into the rear side, the first notch being positioned adjacent to the aperture;

an insert panel being removably couplable to the base, the insert panel being positioned in the aperture of the base when the insert panel is coupled to the base, the insert panel comprising a body and a first tab, the first tab being coupled to the body, the first tab being received into the first notch when the insert panel is coupled to the base, the first notch being shaped such that the first tab snap fits to the base when the first tab is received into the first notch;

an indicia being coupled to a front face of the insert panel; and wherein the insert panel has a peripheral edge being coextensive with a perimeter of the aperture when the insert panel is coupled to the base.

2. The apparatus of claim 1, wherein the base has a second notch extending into the rear side, the second notch being positioned adjacent to the aperture, the insert panel comprising a second tab being coupled to the body of the insert panel, the second tab being received into the second notch when the insert panel is coupled to the base, the second notch being shaped such that the second tab snap fits to the base when the second tab is received into the second notch.

3. The apparatus of claim 2, wherein the second notch is different in one of size and shape to the first notch such that the insert panel cannot be coupled to the base with the first tab being received into the second notch and the second tab being received into the first notch.

4. The apparatus of claim 3, wherein the second notch has a different size to a size of the first notch.

5. The apparatus of claim 2, wherein the second notch is positioned across the aperture from the first notch.

6. The apparatus of claim 1, wherein the peripheral edge has a circular shape.

7. The apparatus of claim 1, wherein the base has an exterior surface extending between the front side and the rear side, the interchangeable jewelry apparatus further comprising an attachment loop, the attachment loop being coupled to the exterior surface of the base, the attachment loop being positioned adjacent to the first notch of the base.

8. The apparatus of claim 7, wherein the exterior surface has a circular shape, the exterior surface being rounded between the front side and the rear side.

9. The apparatus of claim 7, further comprising a necklace being attached to the attachment loop, the necklace having a pair of segments, each segment of the pair of segments extending away from the attachment loop.

10. The apparatus of claim 7, further comprising:

a hook being coupled to the attachment loop, the hook having a size such that the hook is configured for inserting through a piercing hole of an ear; and a catch being removably coupled to the hook, the catch being slidably positionable on the hook into a selected position such that the catch is frictionally secured to the hook, the catch being configured for securing the hook through the piercing hole of the car.

11. The apparatus of claim 1, wherein the base has an exterior surface extending between the front side and the rear side, the exterior surface having a hexagonal shape.

12. The apparatus of claim 1, further comprising a safety pin being coupled to the rear side of the base, the safety pin extending across the aperture.

13. An interchangeable jewelry apparatus comprising:

a base having an aperture extending through a front side and a rear side of the base, the base having a first notch extending into the rear side, the first notch being positioned adjacent to the aperture;

an insert panel being removably couplable to the base, the insert panel being positioned in the aperture of the base when the insert panel is coupled to the base, the insert panel comprising a body and a first tab, the first tab being coupled to the body, the first tab being received into the first notch when the insert panel is coupled to the base, the first notch being shaped such that the first tab snap fits to the base when the first tab is received into the first notch;

an indicia being coupled to a front face of the insert panel; and wherein the base has a seat surface extending around the aperture and facing rearwardly with respect to the front side of the base, the front face of the insert panel abutting the seat surface of the base when the insert panel is coupled to the base.

14. An interchangeable jewelry apparatus comprising:

a base having an aperture extending through a front side and a rear side of the base, the base having a first notch extending into the rear side, the first notch being positioned adjacent to the aperture, the base having a second notch extending into the rear side, the second notch being positioned adjacent to the aperture, the second notch being positioned across the aperture from the first notch, the base having a seat surface extending around the aperture and facing rearwardly with respect to the front side of the base;

an insert panel being removably couplable to the base, the insert panel being positioned in the aperture of the base when the insert panel is coupled to the base, the insert panel comprising a body, a first tab, and a second tab, the first tab and the second tab each being coupled to the body, the first tab being received into the first notch when the insert panel is coupled to the base, the second tab being received into the second notch when the insert panel is coupled to the base, a front face of the insert panel abutting the seat surface of the base when the insert panel is coupled to the base, the first and second notches being shaped such that the first and second tabs snap fit to the base when the first and second tabs are received into the first and second notches respectively, the second notch having a different size to a size of the first notch such that the insert panel cannot be coupled to the base with the first tab being received into the second notch and the second tab being received into the first notch, the insert panel having a peripheral edge being coextensive with a perimeter of the aperture when the insert panel is coupled to the base, the peripheral edge having a circular shape; and an indicia being coupled to the front face of the insert panel.

15. The apparatus of claim 14, wherein the base has an exterior surface extending between the front side and the rear side, the exterior surface having a circular shape, the exterior surface being rounded between the front side and the rear side, the interchangeable jewelry apparatus further comprising an attachment loop, the attachment loop being coupled to the exterior surface of the base, the attachment loop being positioned adjacent to the first notch of the base.

16. The apparatus of claim 15, further comprising a necklace being attached to the attachment loop, the necklace having a pair of segments, each segment of the pair of segments extending away from the attachment loop.

17. The apparatus of claim 15, further comprising:

a hook being coupled to the attachment loop, the hook having a size such that the hook is configured for inserting through a piercing hole of an ear; and a catch being removably coupled to the hook, the catch being slidably positionable on the hook into a selected position such that the catch is frictionally secured to the hook, the catch being configured for securing the hook through the piercing hole of the ear.

18. The apparatus of claim 14, wherein the base has an exterior surface extending between the front side and the rear side, the exterior surface having a hexagonal shape, the interchangeable jewelry apparatus further comprising an attachment loop, the attachment loop being coupled to the exterior surface of the base, the attachment loop being positioned adjacent to the first notch of the base.

19. The apparatus of claim 14, further comprising a safety pin being coupled to the rear side of the base, the safety pin extending across the aperture.

* * * * *